United States Patent [19]

Wark et al.

[11] Patent Number: 4,966,689

[45] Date of Patent: Oct. 30, 1990

[54] SELF-CLEANING GRATE ASSEMBLY

[76] Inventors: Rick Wark, 2217 N. Lk. Angelus Rd.; Philip H. Christos, 2817 Silverstone, both of Pontiac, Mich. 48055; Karl M. Williamson, 27356 Maywood, Roseville, Mich. 48066

[21] Appl. No.: 298,864

[22] Filed: Jan. 13, 1989

Related U.S. Application Data

[63] Continuation of Ser. No. 17,468, Feb. 20, 1987, abandoned.

[51] Int. Cl.[5] ..... B07B 1/50

[52] U.S. Cl. ..... 209/384; 209/387; 209/393; 241/81

[58] Field of Search ..... 209/379, 384, 244, 393, 209/396, 235, 283, 385, 627, 387; 171/12, 13, 25, 87, 89; 241/81, 68, 78, 80, 24

[56] References Cited

U.S. PATENT DOCUMENTS

| | | | |
|---|---|---|---|
| 361,000 | 4/1887 | Creager | 209/283 X |
| 873,049 | 12/1907 | Irving | 209/393 |
| 1,318,215 | 10/1919 | McCoy | 209/283 X |
| 1,439,699 | 12/1922 | Fisk | 209/393 X |
| 1,529,370 | 3/1925 | Nelson | 209/283 |
| 1,567,075 | 12/1925 | Pates | 209/384 |
| 3,106,523 | 10/1963 | Couture | 241/81 |
| 3,363,847 | 1/1968 | Joa | 241/81 |
| 3,848,744 | 11/1974 | Flaherty | 209/393 |
| 3,934,826 | 1/1976 | Graveman | 241/81 |
| 3,993,567 | 11/1976 | Ginavin | 209/393 |
| 4,326,674 | 4/1982 | Braun et al. | 241/81 |
| 4,558,787 | 12/1985 | Danielsson et al. | 209/379 |
| 4,637,557 | 1/1987 | Vitunac | 209/384 X |

FOREIGN PATENT DOCUMENTS

| | | | |
|---|---|---|---|
| 23520 | 6/1907 | Sweden | 209/393 |
| 1199264 | 12/1985 | U.S.S.R. | 241/81 |
| 1555028 | 11/1979 | United Kingdom | 209/379 |

OTHER PUBLICATIONS

Arthur Taggert, *Handbook of Mineral Dressing,* 1945, pp. 7-21 to 7-24.

*Primary Examiner*—Donald T. Hajec
*Attorney, Agent, or Firm*—Brooks & Kushman

[57] ABSTRACT

The apparatus includes a housing having an inlet for coal and the like and two outlets, a sizing grate, a comb, and means for moving the comb relative to the grate for dislodging granular material clogged therein. The grate is affixed to the housing and provides a plurality of openings which are sized to allow granular material of a predetermined size to pass therethrough to the first outlet, while granular material of a greater size is the second outlet to a crusher. The invention also includes a method of automatically sizing granular material using a self-cleaning grate assembly.

11 Claims, 6 Drawing Sheets

SELF-CLEANING GRATE ASSEMBLY

RELATED APPLICATIONS

This is a continuation application of Ser. No. 017,468, filed Feb. 20, 1987, now abandoned.

BACKGROUND OF INVENTION

This invention relates to sizing grates for granular material and more particularly for self-cleaning devices particularly adapted for coal handling. Coal as removed from the mine is for the most part too large for commercial power plant purposes. In order to bring the mine run coal to a commercially acceptable size, it is processed through a coal crusher which reduces the maximum granule size to 0.75 to 1 inch. The granule size of mine run coals varies dramatically and is influenced by such factors as the type of coal, the particular mine, the amount handling and the method of transportation and storage. It is not uncommon for as much as fifty percent of the mine run coal processed through the crusher to be already below the maximum desired size. Further crushing the already small coal granules results in an increase in fines (small or dust-like particles) which cause serious handling problems. Also passing already properly sized coal through the crusher reduces crusher capacity, increases crusher power consumption and more importantly increases the likelihood of the crusher jamming or "mill skid".

While the concept of automatically sizing coal to allow the already properly sized coal to bypass the crusher seems simple, from a practical standpoint, it is an enormously difficult task. A typical coal crusher in a power plant will process one to two million tons of coal per year. Any coal sizing grate system has to be capable of withstanding continuous use in a very harsh, abrasive environment. When grates have been used in the past, it is frequently necessary to shut the machine down and clean the coal lodged in the grate apertures using a spud or wand directing compressed air through the grate openings. This was a time-consuming and labor intensive process making sizing grates impractical and rarely used in coal power plants.

An object of the present invention is to provide a grate for sizing the granular material such as coal or the like and to separate which are less than a predetermined size. Another object of the invention is to provide a sizing grate which will not be clogged and rendered unusable by material granules. Another object of the invention is to provide a durable sizing grate with high reliability and a long useful life.

SUMMARY OF THE INVENTION

Accordingly the self-cleaning sizing grate assembly of the present invention includes a housing having an inlet and two outlets, a sizing grate, a comb and a drive means for moving the comb. The grate is affixed to the housing and is provided with a plurality of openings therein which are sized to allow granular material of a predetermined size to pass through into the first outlet while granular material of greater size are directed to the second outlet. The comb is provided with a plurality of projections which fit into the grate openings and are shiftable relative thereto to free the granules lodged in the grate openings. The drive means moves the comb relative to the grate to maintain the grate in an open state.

A method of sizing granular material using such a sizing grate is also described, including the steps of delivering granular material to a sizing apparatus, pouring the material into the apparatus, automatically granules which are larger than or smaller than a predetermined size using a sizing grate, automatically cleaning of the grate and crushing the large granules thereby allowing the smaller granules to bypass the crushing operation. These and other novel characteristics of the invention are hereinafter described and claimed.

DETAILED DESCRIPTION OF THE PREFERRED EMBODIMENT

Figure 1:
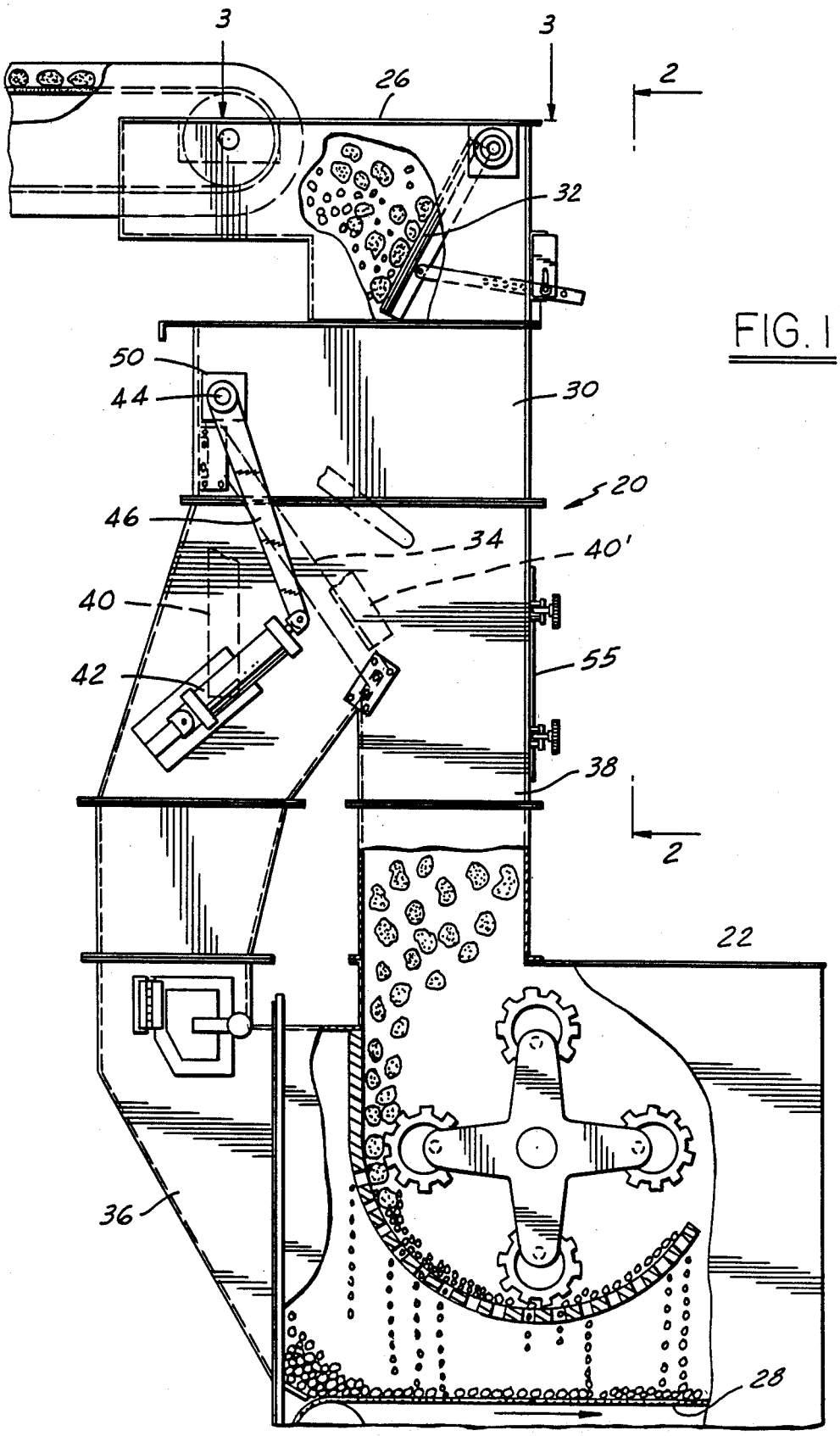
FIG. 1 is a partially cut-away side elevation, the self-cleaning sizing grate assembly of the present invention shown attached to a coal crusher and provided with an inlet and outlet conveyer for handling coal.
Figure 2:
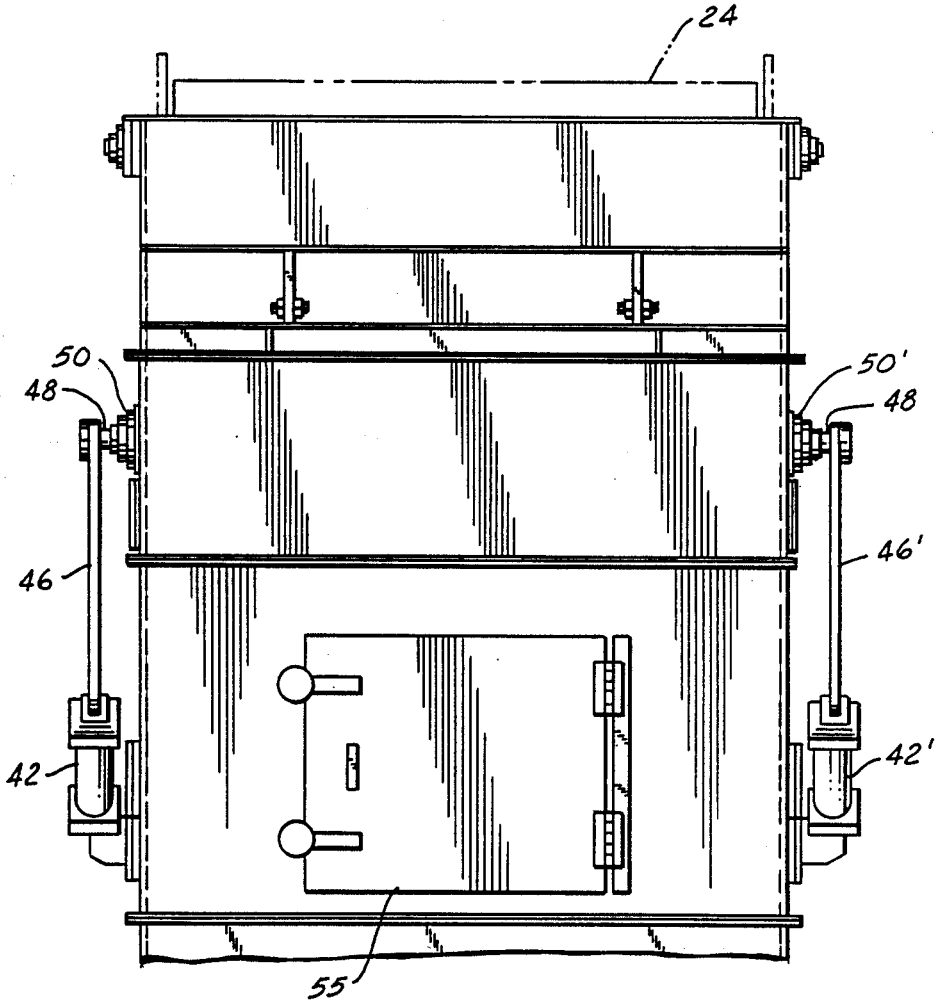
FIG. 2 is a front view taken along line 2—2 of FIG. 1.

The preferred embodiment of the invention is illustrated by way of example in FIGS. 1 through 9. The self-cleaning sizing grate assembly 20 is shown attached to coal crusher 22. Oriented above coal crusher 22 is conveyer 24 which provides a source of mill run coal to the grate assembly inlet 26. Exit conveyer 28 is provided below the coal crusher 22 to remove the sized coal.

The sizing grate assembly 20 is provided with a generally vertical housing 30, the upper end of which forms inlet 26 for granular materials such as coal and the like. The embodiment of the invention shown in the drawings is specifically designed to crush coal and will be described as such, however, it should be noted that the device can be easily adapted for use with other granular materials desired to be sized.

The coal deposit in inlet 26 during the initial part of its fall impinges upon deflector 32. The coal granules upon impact into deflector are further broken up and the fall is redirected so as to strike grate 34 whereupon particles of less than a predetermined size are automatically separated from those greater than a predetermined size. Grate 34 is made up of a series of parallel spaced-apart bars having openings therebetween of a selected size to allow material less than a predetermined size to pass therethrough in to fines chute 36. Larger material unable to pass through the bars is deflected by same and are routed through exit chute 38 into crusher 22. The coal falling through the fines chute and the coal after being processed by crusher 22 both deposit on conveyer 28 for transportation to the coal preparation process. The sizing grate assembly therefore allows coal which is already the proper size to to be simply bypassed around the crusher to achieve a number of the previously described advantages.

The self-cleaning sizing grate 20 shown in FIG. 1 is provided with a comb 40 which is shown in phantom outline which pivotably cooperates with the housing and has a plurality of projections sized to fit through the grate openings intersecting the grate surface and projecting into the fines chute. The comb is shiftable from a generally vertical normal position 40 where the grate bars are open to an inclined cleaning position 40' where the comb is rotated causing the comb bars to substantially occupy the openings between the grate bars displacing any coal lodged therein. The comb assembly is moved into and out of its cleaning position by a drive means, such as hydraulic cylinder 42 shown in FIG. 1. A number of alternative mechanical drive mechanisms can be used such as a pneumatic cylinder, mechanical linkage mechanism such as a rod and crank. As the comb moves through its cleaning cycle, the point of intersection of the comb bars and the grate surface sequentially advances traversing the grate surface before returning to the normal vertical position. The comb bars form an obtuse angle relative to the grate surface in the preferred embodiment in the normal and cleaning positions.

In operation, the drive means will periodically move the comb through the grate. The cleaning cycle frequently will depend upon the condition of the coal being processed. The cleaning cycle may take place as frequent as once an hour or as frequently as once a minute as the conditions may warrant. The combs when not in use are shifted to an inoperative position whereby the grate openings are free to pass coal therebetween.

The comb assembly 40 comprises a number of spaced apart comb bars which are cantileveredly supported on a generally horizontal shaft. The shaft is pivotably attached to the housing 30 and the ends of the shaft are each provided with drivearm 46 for attachment to cylinder 42. As shown in the front view of the apparatus in FIG. 2, shaft 44 is provided with two ends 48 and 48' which project through bearings 50 and 50' to pivotably attach shaft 44 to housing 30. Each end or the shaft is provided with an arm 46 which is attached to the hydraulic cylinder 42. It is desirable that the shaft be driven at both ends so as to minimize the maximum torque thereon during a cleaning cycle. The door 55 in housing 30 provide access to the grate and comb assemblies for repair and maintenance purposes.

Figure 3:
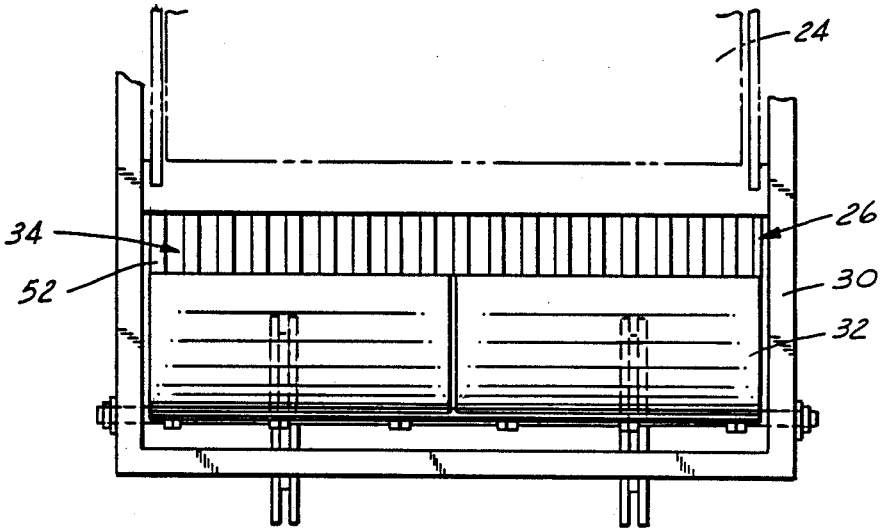
FIG. 3 is a top view taken along line 3—3 of FIG. 1.
Figure 4:
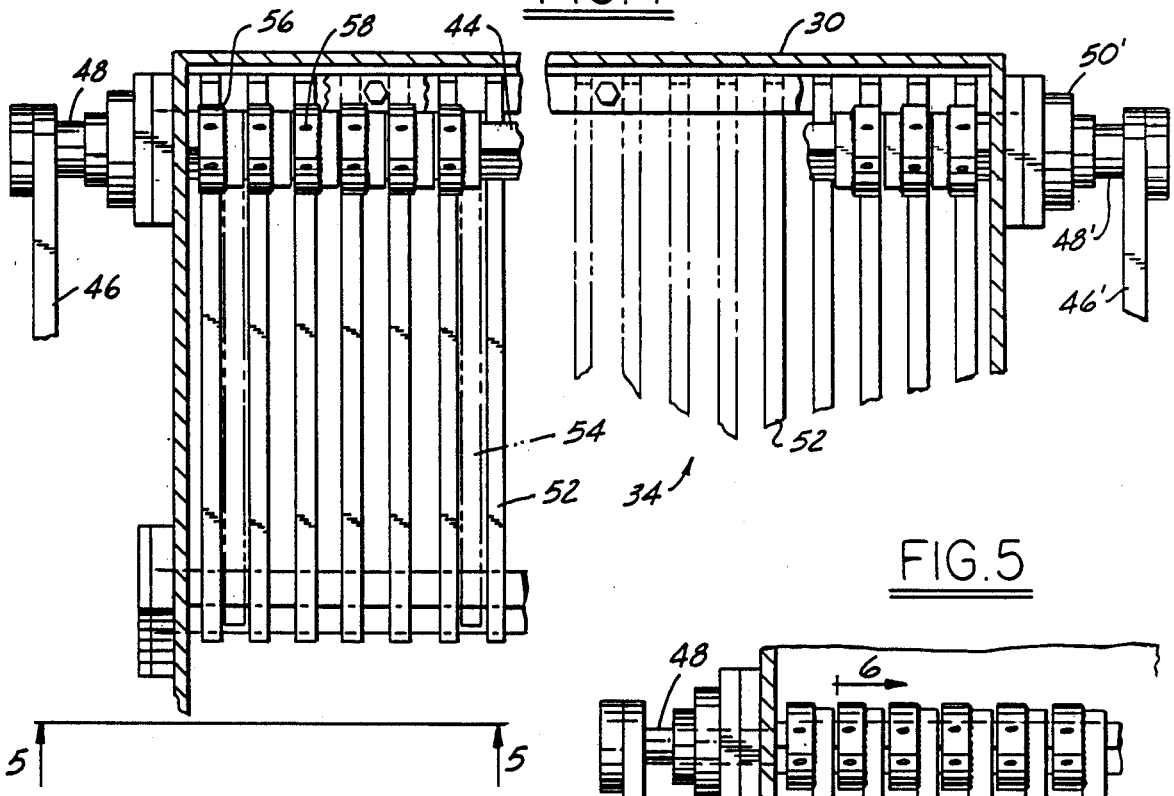
FIG. 4 is an enlarged partially cut-away plan view of the comb assembly.
Figure 5:
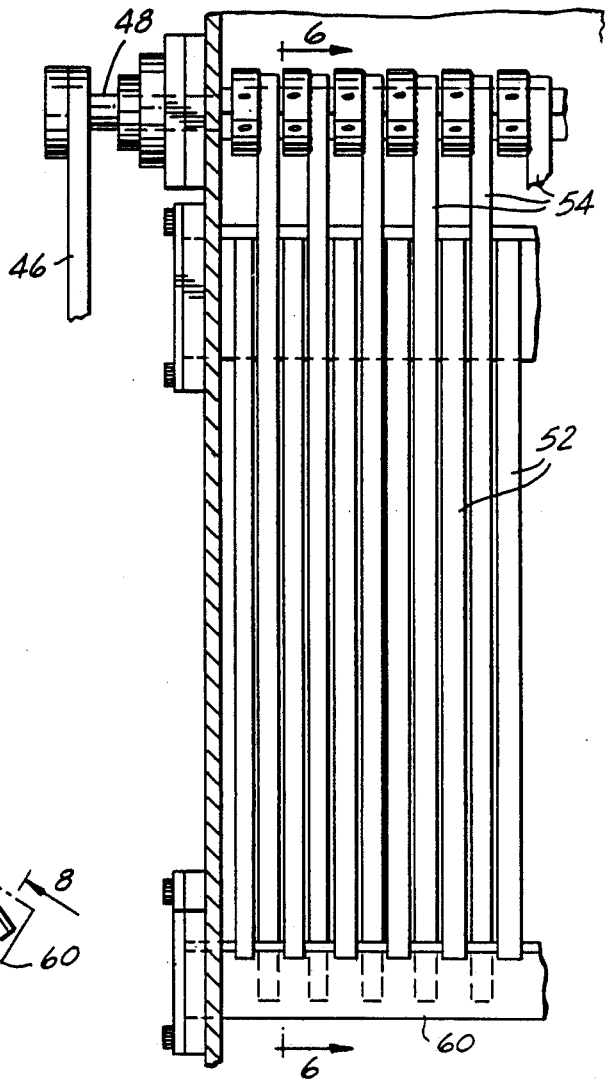
FIG. 5 is a front view of the comb assembly taken along line 5—5 of FIG. 4.

A plan view of the sizing grate assembly and associated inlet conveyer is shown in FIG. 3. Incoming coal conveyer 24 will be projected onto deflector 32 and will fall on grate 34. Grate 34 is made up of a plurality of generally parallel spaced apart grate bars 52. Grate bars 52 are removably attached at each end to housing 30. Alternatively spaced between grate bars 52 are comb bars 54. The comb bars 54 are affixed to shaft 44 at one end and cantileveredly project therefrom. Preferably the central portion of shaft 44 is provided with at least one flat face preferably a plurality of a number of flat faces forming a polygon such as the hexagon shown, to aid in the mechanical attachment or comb bars 54 to shaft 44. Each comb bar is provided with a collar 56 welded thereto having a hexagon shaped opening therein corresponding to the size of shaft 44. The collars not only serve to removably affix the bars to the shaft but also serve to properly space apart the bars along the shaft axis. Each collar 56 is provided with a set screw 58 to prevent the comb bars from shifting relative to the shaft.

Figure 6:
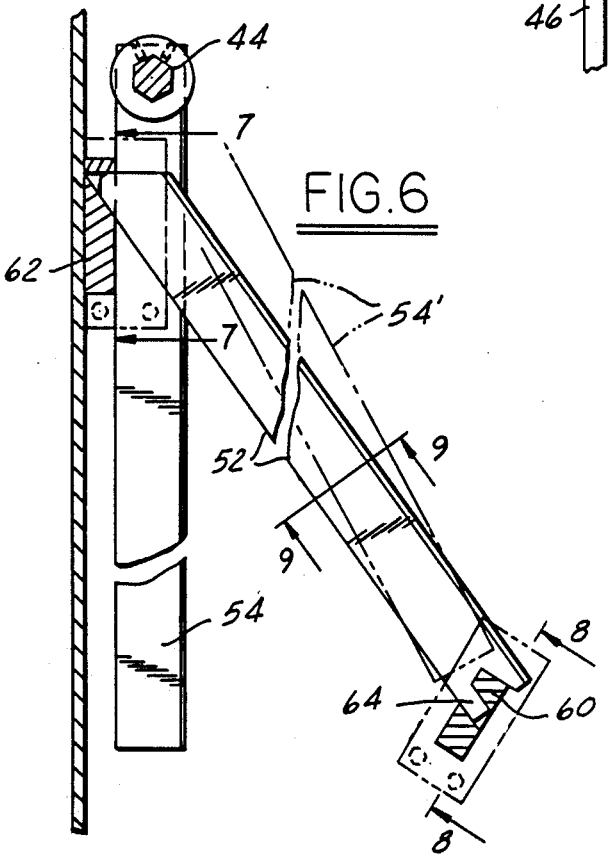
FIG. 6 is a side cross-sectional view taken along line 6—6 of FIG. 5.
Figure 7:
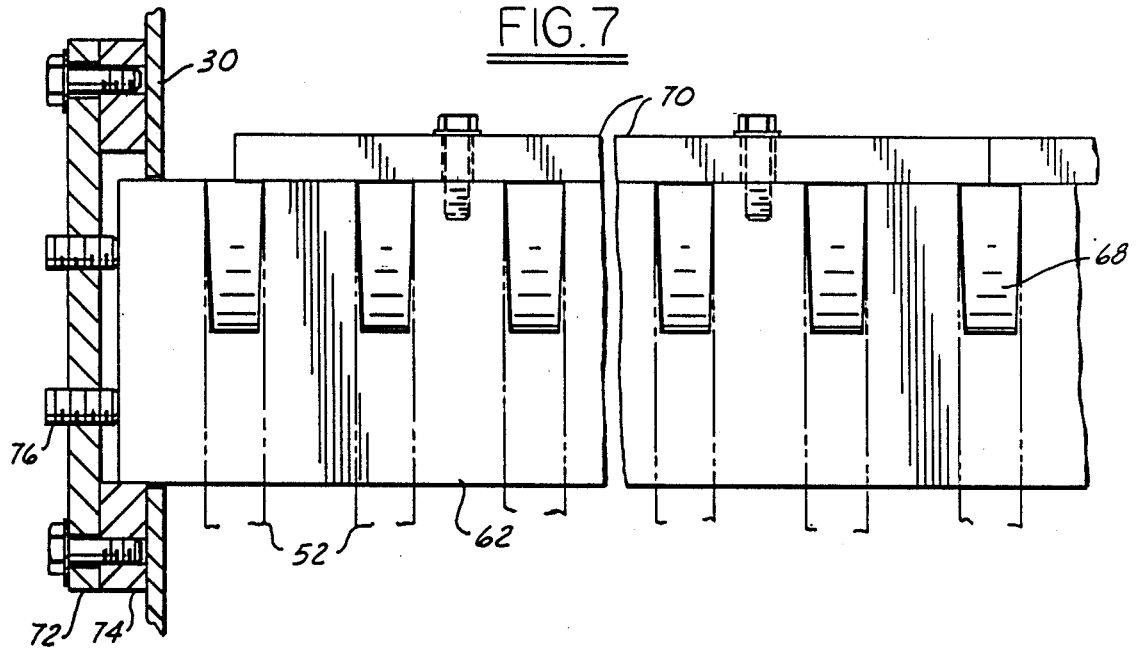
FIG. 7 is a front cross-sectional view taken along line 7—7 of FIG. 6.
Figure 8:
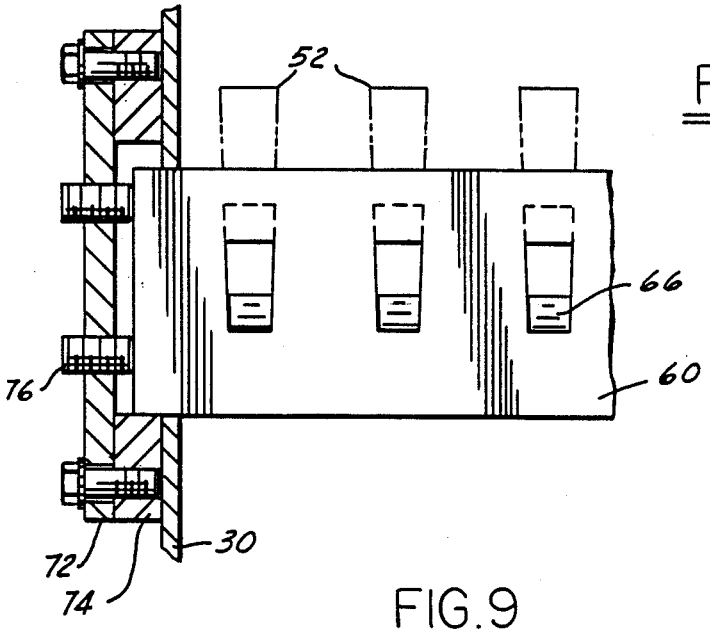
FIG. 8 is a cross-sectional view taken along line 8—8 of FIG. 6.

Shaft 44 is oriented generally perpendicular to both comb bars 52 and grate 54. The shaft is normally oriented so that the comb bars are generally vertical as shown in FIG. 6 so as to maintain the openings between the grate bars unobstructed. During the cleaning cycle, shaft 44 is rotated causing grate bars 54 to move to the position shown in phantom outline in FIG. 6 to dislodge any material granules trapped between the bar whereupon the comb bars return to their original vertical position. Note that the comb shaft is limited in rotation so that the comb bars are always in meshing engagement with the grate bars preventing the possibility of misalignment and jamming from occurring.

The grate bars are removably secured to the housing by a lower retaining plate 60 and an upper retaining plate 62. Each of the grate bars, 52 is provided with a generally Y-shaped lower end 64. The lower retainer 60 is provided with a plurality of spaced apart holes 66 formed wherein for receiving one branch of bar Y-shaped end portions 64. The lower retainer bar is securely wedged within the grate Y-shaped portions 64 to prevent any relative rotation of the bar about its axis. The upper end of grate bar 54 fits within a series of spaced bar notches 68 formed in upper retainer plate 62. The grate bars are securely maintained n the notches 68 formed in the upper retainer by cap 70 which is fastened thereto. Cap 70 prevents any axial or transverse movement of the grate bar.

The upper and lower retainers 60 and 62 are affixed to the housing 30 by a pair of simple locator plates 72 and 74 which provide easy means for disassembly of the entire grate structure in the event repair or maintenance is required. Retainer adjustment bolts 76 are provided to shift the upper and lower retainers horizontally to properly align the grate bars so that they are perpendicular to the shaft and centered in between the comb bars.

Figure 9:
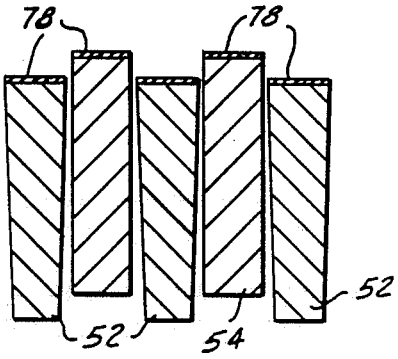
FIG. 9 is a cross-sectional view taken along line 9—9 of FIG. 6.

As shown in FIG. 9 both the comb bars and the grate bars are preferably provided with a hardened face, bonded or otherwise clad to the surface of the bars to provide a durable long-wearing surface. Preferably hardened face 78 is formed of chromium carbide or a like material which can be affixed to the bar using a welding technique. After prolonged use after the chromium carbide surface begins to wear, it can be rebuilt in place by a technician reapplying more chromium carbide weld material directly on the bars and without removal from the apparatus. As can also be seen in FIG. 9, grate bars 52 are slightly tapered in cross-section having the maximum width at face 78 and the minimum width at the side of the bar opposite thereto. This tapered design causes the distance between two adjacent grate bars to increase as a function of the distance from the bar face minimizing the loading of coal therebetween.

Control Circuit

Figure 15:
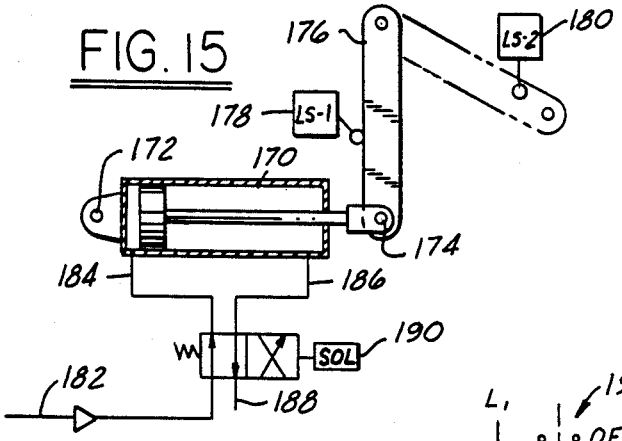
FIG. 15 is a pneumatic schematic diagram of a control.
Figure 16:
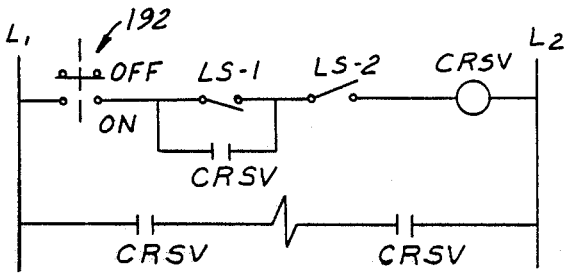
FIG. 16 is an electrical schematic diagram of a control circuit.

By way of example, a typical pneumatic and electrical control circuit is shown in FIGS. 15 and 16 respectively. Pneumatic cylinder 170 is one end 172 pivotably affixed to the sizing apparatus housing which is not shown and the other end, 174 pivotably affixed to arm 176 which is attached to the comb assembly. Arm 176 is pivotably between a first and second position to move the comb assembly relative to the grate to dislodge the loosened particles as previously described. A first and second limit switch 178 and 180 detect the presence of arm 176 at the two extremes of its travel. The cylinder shown in FIG. 15 is in the retracted position. When the arm is in the full clockwise position as shown, limit switch LS-1 is closed and pressurized air line 182 is coupled to cylinder input/output port 184. The other cylinder input/output port 186 is coupled to exhaust by control relay of solenoid valve 190. In the present configuration, pressurized air from 192 will flow through control relay solenoid valve 190 to the pneumatic cylinder 170 causing it to extend. When the cylinder has extended sufficiently to cause arm 176 to contact the second limit switch 180 control relay solenoid valve will shift connecting the pneumatic air line 182 to input-/output 182 to input/output 186 and connecting input-/output 184 to exhaust 188 to drive the cylinder in the opposite direction. A simple electrical schematic of the control relay solenoid valve and limit switch is shown in FIG. 16. As shown the comb will continuously sweep as long as the on-off switch 192 is in the on position.

There are countless ways to control the operation of the comb movement from a control standpoint. As previously indicated, some customers will prefer to cycle the comb periodically as opposed to cycling it continuously. Periodic cycling can be simply achieved by using a simple on/off time mechanism. Alternatively a programmable controller or computer controller could be used to control cylce operation as is well known in the art.

Alternative Embodiment to the Invention

An alternative embodiment to the invention is shown in FIGS. 9 through 14. The self-cleaning sizing grate assembly 100 is provided with a housing 102 having an upper inlet 104, a fines chute 106, a pair of coal exit chutes 108 and 110. Mine run coal is poured into the housing inlet 104. The coal initially strikes deflector 112 and baffles 114 and 116 which generally divide the incoming coal into two equal portions and direct the coal onto grate assembly 118. Grate assembly 118 is formed of a plurality of spaced apart parallel bars 120 which are generally arcuately shaped when viewed in the side elevation and are affixed at each end to housing 102 at opposite sides of the fine chute inlet. Grate bars 120 are spaced apart a predetermined distance in order to properly size the coal. Fines fall through the bars into the fines chute and the larger granules rolling off of a grate assembly to flow through exit chutes 108 and 110 for transportation to their respective crushers (not shown).

Figure 10:
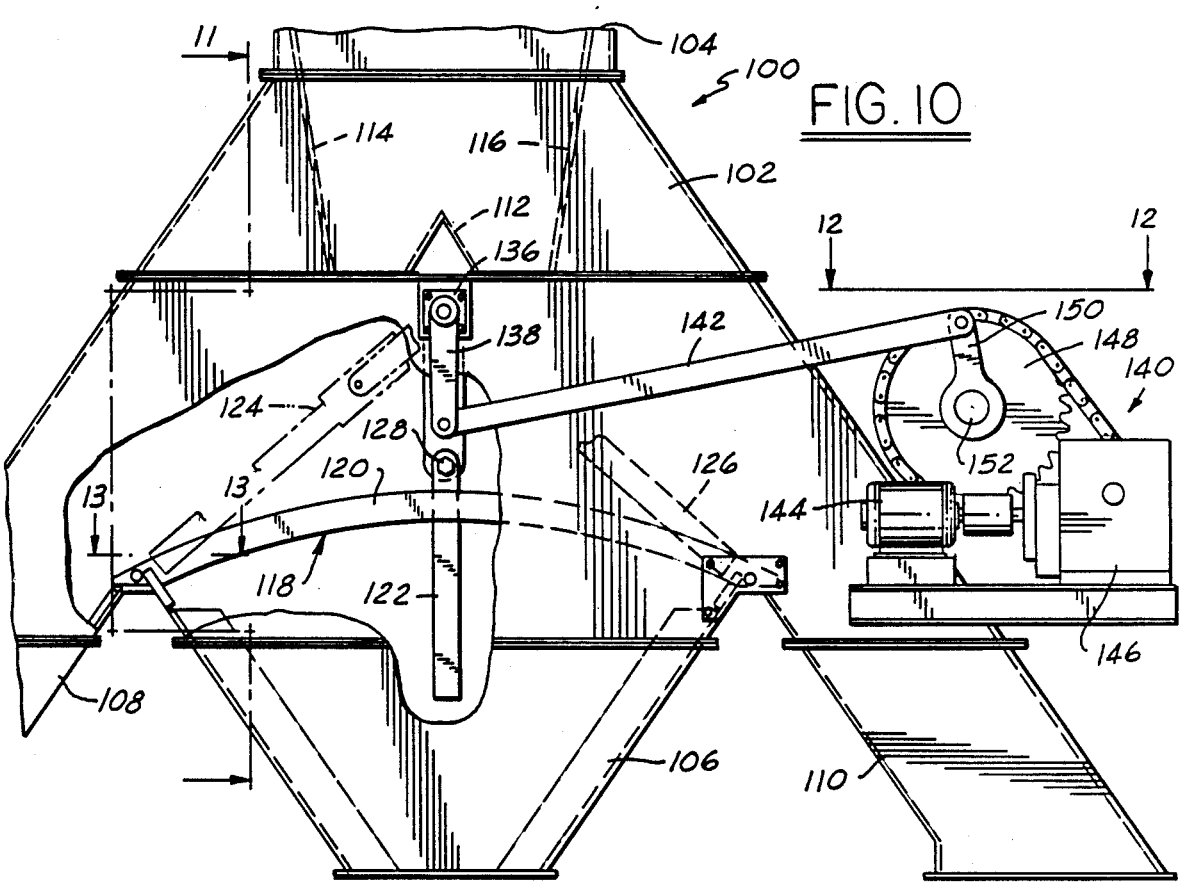
FIG. 10 is a partially cut-away view of an alternative embodiment of the invention.
Figure 11:
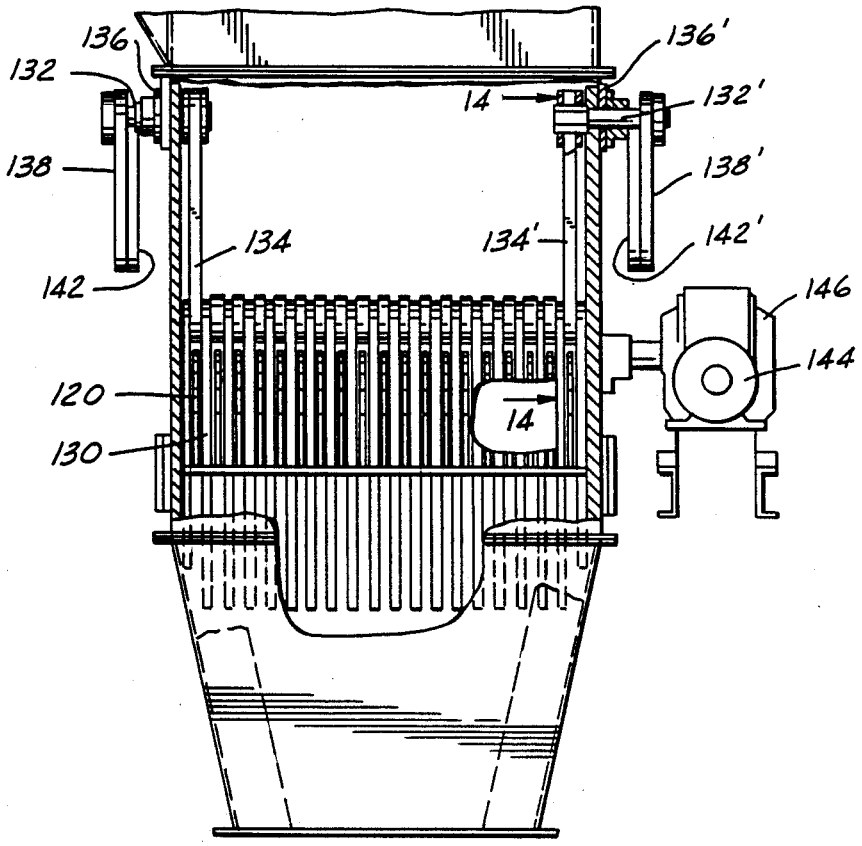
FIG. 11 is a cross-sectional view taken along line 11—11 of FIG. 10.
Figure 12:
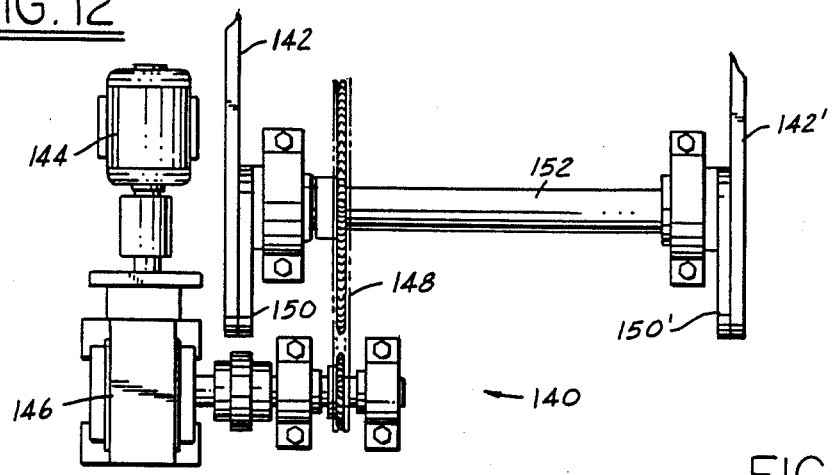
FIG. 12 is a plan view taken along line 12—12 of FIG. 10.

When the grate assembly 120 becomes clogged as inevitably will occur, comb assembly 122 which at rest is maintained in the vertical position will go through a cleaning cycle. The comb will first clean one half of the grate by moving to position 124 adjacent chute 108 shown in phantom outline and then clean the opposite side of the grate by moving to position 126 adjacent chute 110, after which the comb returns to the central position as the comb moves through the cleaning cycle, the point of intersection of the comb bars and the grate surface sequentially advances, traversing the grate surface to one side and then to the next before returning to the normal vertical position. In a vertical position, the comb bars are generally perpendicular to the grate. The comb forms an obtuse angle relative to the grate surface as it moves to the cleaning position, as shown in FIG. 10. The comb like that in the first embodiment is provided with a generally horizontal shaft to which a plurality of comb bars 130 are attached. The shaft is preferably polygon shaped and the comb bars preferably have polygon openings in one end thereof for securely mounting on the shaft. Unlike the first embodiment the comb assembly is not pivoted about the axis of shaft 128 but rather is pivoted about a parallel axis spaced therefrom lying between stub shafts 132 and 132'. The comb shaft 128 is affixed to stub shafts 132 and 132' by rails 134 and 134'.

The stub shafts, the comb rails, the comb shaft and the comb bars all form a rigid comb assembly which is rotatable about bearing 136 and 136' rotably cooperating with the stub shafts and supported on housing 102. The stub shafts project out of opposite sides of the housing and have arms 138 and 138' affixed thereto. The arms are coupled to the mechanical drive unit 140 which serves as a drive means by connecting rods 142 and 142'. Drive unit 140 consists of an electric motor 144 which is connected to a gear reduction unit 146 the output of which is coupled to sprocket 148 having affixed thereto crank 150. During a cleaning cycle the motor is rotated sufficiently to cause the sprocket to complete one full revolution and come to rest at its neutral position shown in FIG. 10. Appropriate timers and/or limit switches are provided to control such movement as is well-known in the art. As can be seen from the plan view of the drive unit shown in FIG. 12, the comb assembly is driven on both sides by connecting rods 142 and 142' which are pivotably connected to crank arms 150 and 150' mounted on opposite sides of crank shaft 152.

Figure 13:
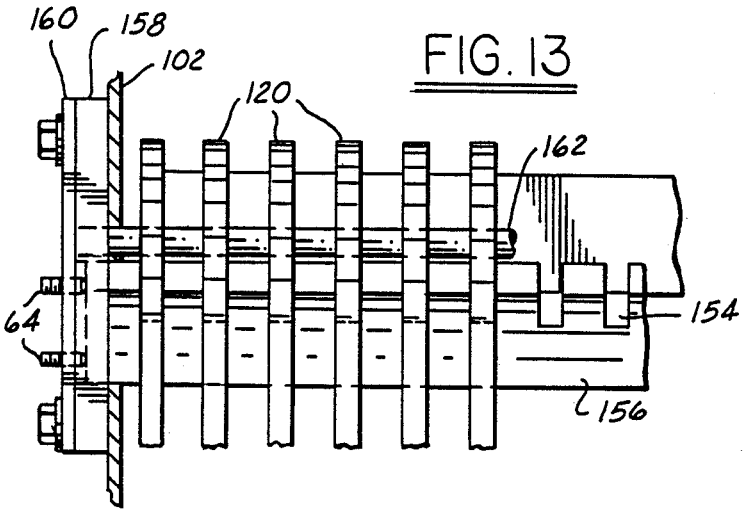
FIG. 13 is a partial sectional view taken along line 13—13 of FIG. 10.

A detail of the grate bar housing attachment is shown in FIG. 13. Each end of the grate bars 120 sit securely within one of a plurality of notches, 154 formed in retained bar 156. Retaining bar 156 is held in place by locator plates 158 and 160 which are affixed to housing location can be made with adjustment screw 64 and the corresponding adjustment screw on the opposite side are not shown.

Figure 14:
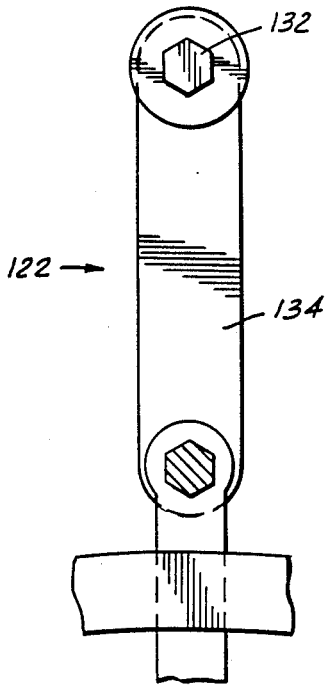
FIG. 14 is a sectional view taken along line 14—14 of FIG. 11.

Enlarged cross-sectional view of the comb assembly is shown in FIG. 14. As can be shown from FIG. 14 and FIG. 11, the space generally bounded by shaft 128, comb rails 134 and 134' and the axis of stub shafts 132 is generally open. This open area is provided to allow coal flow when the comb assembly is moving through a cleaning operation. Since the flow of coal does not stop during cleaning if this open area was not provided, coal impacting upon the comb assembly would cause excessive loads on the drive mechanism.

Method of Sizing Granular Material

To the extent not previously described the method of sizing granular material using automatic sizing grates will be described in more detail. Both the first and second embodiments of the invention function using basically the same method, granular material such as coal or the like is delivered to the sizing apparatus. The coal is poured into the sizing apparatus which is provided with a coal inlet and a first and second outlet. The coal is poured onto a sizing grate within the apparatus whereby coal less than a predetermined size passes through the grate and exits through the first exit and coal greater than a predetermined size is directed to the second exit. The grate is automatically cleaned periodically by a comb which is moved relative to the grate to dislodge granules clogging the grate opening. The method also includes the step of crushing the coal exiting through the apparatus second exit and removing the output of the coal crusher as well as the material from the apparatus' first exit which bypassed the crushing step.

It will also be understood, of course, that while the form of the invention herein shown and described well as the material from the apparatus' first exit which bypassed the crushing step.

It will also be understood, of course, that while the form of the invention herein shown and described constitutes a preferred embodiment of the invention, it is not intended to illustrate all possible forms thereof. It will also be understood that the words used are words of description rather than limitation and various changes may be made without departing from the spirit and scope of the invention disclosed.

We claim:

1. A self cleaning sizing grate assembly for granular material such as coal or the like comprising:

a housing having a generally vertical inlet chute for receiving granular material, a lower outlet providing a fines chute for granular material smaller than the predetermined size, and an exit chute for material greater than the predetermined size;

a grate affixed to the housing through which material entering the fines chute must pass, said grate further comprising a plurality of parallel, spaced-apart grate bars defining a grate surface having a plurality of parallel openings formed therein;

a comb cooperating with the housing and the grate and movable relative thereto during a cleaning cycle to clear material lodged between the grate bars, said comb further comprising a support shaft pivotably attached to the housing and a plurality of comb bars cantileveredly affixed to said shaft and projecting perpendicular thereto arranged to fit between the openings between the grate bars, wherein said comb projects through the grate surface at a point of intersection and, is shiftable between a normal position and a cleaning position upon the rotation of the shaft causing the point of intersection of the comb bars and the grate surface to sequentially advance, traversing the grate before returning to the normal position at the completion of the cleaning cycle; and drive means for periodically rotating the comb shaft to cause the comb to move in an oscillating manner to clean the grate surface.

2. The invention of claim 1, wherein said comb support shaft is pivotably attached to the housing within the inlet chute, with said comb bars projecting through the grate surface into the fines chute.

3. The invention of claim 1, further comprising control means for periodically causing the drive means to move the comb to clean the grate.

4. The invention of claim 1 wherein said comb in the normal position is generally vertical and in the cleaning position it is inclined.

5. The invention of claim 4, wherein the comb bars form an obtuse angle relative to the grate surface and the material lodged between the grate bars during the advancement of the comb relative to the grate during the cleaning cycle.

6. The invention of claim 4, wherein said grate surface is inclined.

7. The invention of claim 4, wherein said grate bars are individually removably attachable to the housing, and the comb bars are individually removably attachable to the comb support shaft to enable the comb and grate bars to be replaced when necessary.

8. The invention of claim 7, wherein said comb bars and grate bars are provided with a relatively hard wear-resistant face in direct contact with the granular material being sized.

9. The invention of claim 8, wherein said comb bars and grate bars have a substantially tapered cross-section which is widest at the face and getting progressively smaller the greater the distance therefrom to minimize the likelihood of material lodging between adjacent bars.

10. A self cleaning sizing grate assembly for granular material such as coal or the like comprising:

a housing having a generally vertical inlet chute for receiving granular material, a plurality of lower outlet chutes providing a fines chute for granular material smaller than the predetermined size, and a pair of exit chutes adjacent opposite sides of the fines chute for material greater than the predetermined size;

a grate affixed to the housing through which material entering the fines chute must pass for deflecting granule of larger than the predetermined size to either of the exit chutes, said grate further comprising a plurality of parallel, spaced-apart grate bars defining a grate surface having a plurality of parallel openings formed therein;

a comb cooperating with the housing and the grate and movable relative thereto during a cleaning cycle to clear material lodged between the grate bars, said comb further comprising a plurality of comb bars arranged to fit between the openings between the grate bars, wherein said comb projects through the grate surface at a point of intersection and is, shiftable between a normal vertical position relative to said grate and a pair of inclined cleaning positions adjacent each exit chute causing the point of intersection of the comb bars and the grate surface to sequentially advance toward each exit chute, said comb traversing the grate before returning to the normal position at the completion of the cleaning cycle; and drive means for periodically rotating the comb shaft to move the comb in an oscillating manner to clean the grate surface.

11. The invention of claim 10, wherein said comb is pivotably attached to the housing within the inlet chute, with said comb bars projecting through the grate surface into the fines chute.

* * * * *